US009633662B2

(12) United States Patent
Jeong et al.

(10) Patent No.: US 9,633,662 B2
(45) Date of Patent: Apr. 25, 2017

(54) FRAME LOSS RECOVERING METHOD, AND AUDIO DECODING METHOD AND DEVICE USING SAME

(71) Applicant: LG ELECTRONICS INC., Seoul (KR)

(72) Inventors: Gyuhyeok Jeong, Seoul (KR); Hyejeong Jeon, Seoul (KR); Ingyu Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/427,778

(22) PCT Filed: Sep. 11, 2013

(86) PCT No.: PCT/KR2013/008235

§ 371 (c)(1),
(2) Date: Mar. 12, 2015

(87) PCT Pub. No.: WO2014/042439

PCT Pub. Date: Mar. 20, 2014

(65) Prior Publication Data

US 2015/0255074 A1 Sep. 10, 2015

Related U.S. Application Data

(60) Provisional application No. 61/700,865, filed on Sep. 13, 2012.

(51) Int. Cl.

| | |
|---|---|
| ***G10L 19/005*** | (2013.01) |
| ***G10L 19/12*** | (2013.01) |
| *G10L 19/02* | (2013.01) |

(52) U.S. Cl.

CPC ..... *G10L 19/005* (2013.01); *G10L 19/12* (2013.01); *G10L 19/0204* (2013.01)

(58) Field of Classification Search

None

See application file for complete search history.

(56) References Cited

U.S. PATENT DOCUMENTS

| | | | | |
|---|---|---|---|---|
| 7,590,525 | B2 * | 9/2009 | Chen | G10L 19/005 704/211 |
| 7,930,176 | B2 * | 4/2011 | Chen | G10L 19/005 704/219 |
| 8,352,260 | B2 | 1/2013 | Sung | |
| 8,457,115 | B2 | 6/2013 | Zhan | |
| 8,620,644 | B2 | 12/2013 | Ryu | |

(Continued)

FOREIGN PATENT DOCUMENTS

| | | |
|---|---|---|
| CN | 101361113 | 2/2009 |
| CN | 101777960 | 7/2010 |

(Continued)

OTHER PUBLICATIONS

Sang-Uk et al.; Endoder Assisted Frame Loss Concealment for MPEG-AAC Decoder; ICASSP 2006, pp. 169-172, 2006.*

(Continued)

*Primary Examiner* — Abul Azad

(74) *Attorney, Agent, or Firm* — Fish & Richardson P.C.

(57) ABSTRACT

The present invention relates to a frame loss recovering method, an audio decoding method, and an apparatus using the method. A method of recovering a frame loss of an audio signal according to the present invention includes: grouping transform coefficients of at least one frame into a predetermined number of bands among previous frames of a current frame; deriving an attenuation constant according to a tonality of the bands; and recovering transform coefficients of the current frame by applying the attenuation constant to the previous frame of the current frame.

11 Claims, 10 Drawing Sheets

(56) References Cited

U.S. PATENT DOCUMENTS

| | | | | |
|---|---|---|---|---|
| 2007/0094009 | A1* | 4/2007 | Ryu | G10L 19/005 704/200.1 |
| 2010/0070268 | A1 | 3/2010 | Sung | |
| 2010/0115370 | A1* | 5/2010 | Laaksonen | G10L 19/005 714/752 |
| 2011/0002266 | A1* | 1/2011 | Gao | G10L 19/26 370/328 |
| 2011/0044323 | A1 | 2/2011 | Zhan | |
| 2011/0264454 | A1* | 10/2011 | Ullberg | G10L 21/038 704/500 |
| 2015/0003632 | A1* | 1/2015 | Thesing | G10L 19/0204 381/98 |

FOREIGN PATENT DOCUMENTS

| | | | |
|---|---|---|---|
| EP | 2 270 776 | B1 | 5/2012 |
| JP | 2006-030609 | A | 2/2006 |
| JP | 2008-111991 | | 5/2008 |
| KR | 10-2006-0035998 | A | 4/2006 |
| KR | 10-2011-0002070 | A | 1/2011 |
| KR | 10-2011-0095236 | A | 8/2011 |
| WO | 2007/051124 | | 5/2007 |
| WO | WO 2009/140870 | A1 | 11/2009 |
| WO | WO 2010/030129 | A2 | 3/2010 |

OTHER PUBLICATIONS

International Search Report dated Jan. 28, 2014 for Application No. PCT/KR2013/008235, 4 pages.

Ryu and Rose, "An MDCT Domain Frame-Loss Concealment Technique for MPEG Advanced Audio Coding," 2007 IEEE International Conference on Acoustics, Speech, and Signal Processing, Apr. 2007, pp. 1-273, XP031462851.

Partial Supplementary European Search Report issued in European Application No. 13837778.3 on Mar. 23, 2016, 7 pages.

* cited by examiner

FRAME LOSS RECOVERING METHOD, AND AUDIO DECODING METHOD AND DEVICE USING SAME

CROSS REFERENCE TO RELATED APPLICATIONS

This application is a U.S. National Phase Application under 35 U.S.C. §371 of International Application No. PCT/KR2013/008235, filed on Sep. 11, 2013, which claims the benefit of U.S. Provisional Application No. 61/700,865, filed on Sep. 13, 2012, the entire contents of which are hereby incorporated by reference in their entireties.

BACKGROUND OF THE INVENTION

Field of the Invention

The present invention relates to coding and decoding of an audio signal, and in particular, to a method and apparatus for recovering a loss in a decoding process of the audio signal.

More particularly, the present invention relates to a recovering method for a case where a bit-stream from a speech and audio encoder is lost in a digital communication environment, and an apparatus using the method.

Related Art

In general, an audio signal includes a signal of various frequency bands. A human audible frequency is in a range of 20 Hz to 20 kHz, whereas a common human voice is in a frequency range of 200 Hz to 3 kHz. There may be a case where an input audio signal includes not only a band in which a human voice exists but also a component of a high frequency band greater than or equal to 7 kHz in which a human voice is difficult to exist.

Recently, with a network development and a growing user demand for a high-quality service, an audio signal is transmitted through various bands such as a narrow band (NB), a wide band (WB), and a super wide band (SWB).

In this regard, if a coding scheme suitable for the NB (having a sample rate of about 8 kHz) is applied to a signal of the WB (having a sampling rate of about 16 kHz), there is a problem in that sound quality deteriorates.

Further, if a coding scheme suitable for the NB (having a sampling rate of about 8 kHz) or a coding scheme suitable for the WB (having a sampling rate of about 16 kHz) is applied to a signal of the SWB (having a sampling rate of about 32 kHz), there is a problem in that sound quality deteriorates.

Accordingly, there is an ongoing development on a speech and audio encoder/decoder which can be used in various environments including a communication environment with respect to various bands ranging from the NB to the WB or the SWB or between the various bands.

Meanwhile, an information loss may occur in an operation of coding a speech signal or an operation of transmitting coded information. In this case, in a decoding operation, a process for recovering or concealing the lost information may be performed. As described above, if a loss occurs in an SWB signal in a situation where coding/decoding method optimized for each band is used, there is a need to recover or conceal the loss by using a different method other than a method of handling a WB loss.

SUMMARY OF THE INVENTION

The present invention provides a method and apparatus for recovering a modified discrete cosine transform (MDCT) coefficient of a lost current frame.

The present invention also provides a method and apparatus for adaptively obtaining, for each band, scaling coefficients (attenuation constants) to recover an MDCT coefficient of a current frame through a correlation between previous good frames of the current frame, as a loss recovery method without an additional delay.

The present invention also provides a method and apparatus for adaptively calculating an attenuation constant by using not only an immediately previous frame of a lost current frame but also a plurality of previous good frames of the current frame.

The present invention also provides a method and apparatus for applying an attenuation constant by considering a per-band feature.

The present invention also provides a method and apparatus for deriving an attenuation constant according to a per-band tonality on the basis of a specific number of previous good frames of a current frame.

The present invention also provides a method and apparatus for recovering a current frame by considering a transform coefficient feature of previous good frames of a lost current frame.

The present invention also provides a method and apparatus for effectively recovering a signal in such a manner that, if there is a continuous frame loss, an attenuation constant derived to be applied to a single frame loss and/or an attenuation constant derived to be applied to the continuous frame loss are applied to a recovered transform coefficient of a previous frame, instead of simply performing frame recovery under the premise of a preceding attenuation.

According to an aspect of the present invention, a method of recovering a frame loss of an audio signal includes: grouping transform coefficients of at least one frame into a predetermined number of bands among previous frames of a current frame; deriving an attenuation constant according to a tonality of the bands; and recovering transform coefficients of the current frame by applying the attenuation constant to the previous frame of the current frame.

According to another aspect of the present invention, an audio decoding method includes: determining whether there is a loss in a current frame; if the current frame is lost, recovering a transform coefficient of the current frame on the basis of transform coefficients of previous frames of the current frame; and inverse-transforming the recovered transform coefficient, wherein in the recovering of the transform coefficient, the transform coefficient of the current frame is recovered on the basis of a per-band tonality of transform coefficients of at least one frame among the previous frames.

According to the present invention, an attenuation constant is adaptively calculated by using not only an immediately previous frame of a lost current frame but also a plurality of previous good frames of the current frame. Therefore, a recovery effect can be significantly increased.

According to the present invention, an attenuation constant is applied by considering a per-band feature. Therefore, a recovery effect considering the per-band feature can be obtained.

According to the present invention, an attenuation constant can be derived depending on a per-band tonality on the basis of a specific number of previous good frames of a current frame. Therefore, an attenuation constant can be adaptively applied by considering a band feature.

According to the present invention, a current frame can be recovered by considering a transform coefficient feature of previous good frames of a lost current frame. Therefore, recovery performance can be improved.

According to the present invention, even if there is a continuous frame loss, an attenuation constant derived to be applied to a single frame loss and/or an attenuation constant derived to be applied to the continuous frame loss are applied to a recovered transform coefficient of a previous frame, instead of simply performing frame recovery under the premise of a preceding attenuation. Therefore, a signal can be recovered more effectively.

DESCRIPTION OF EXEMPLARY EMBODIMENTS

Figure 1:
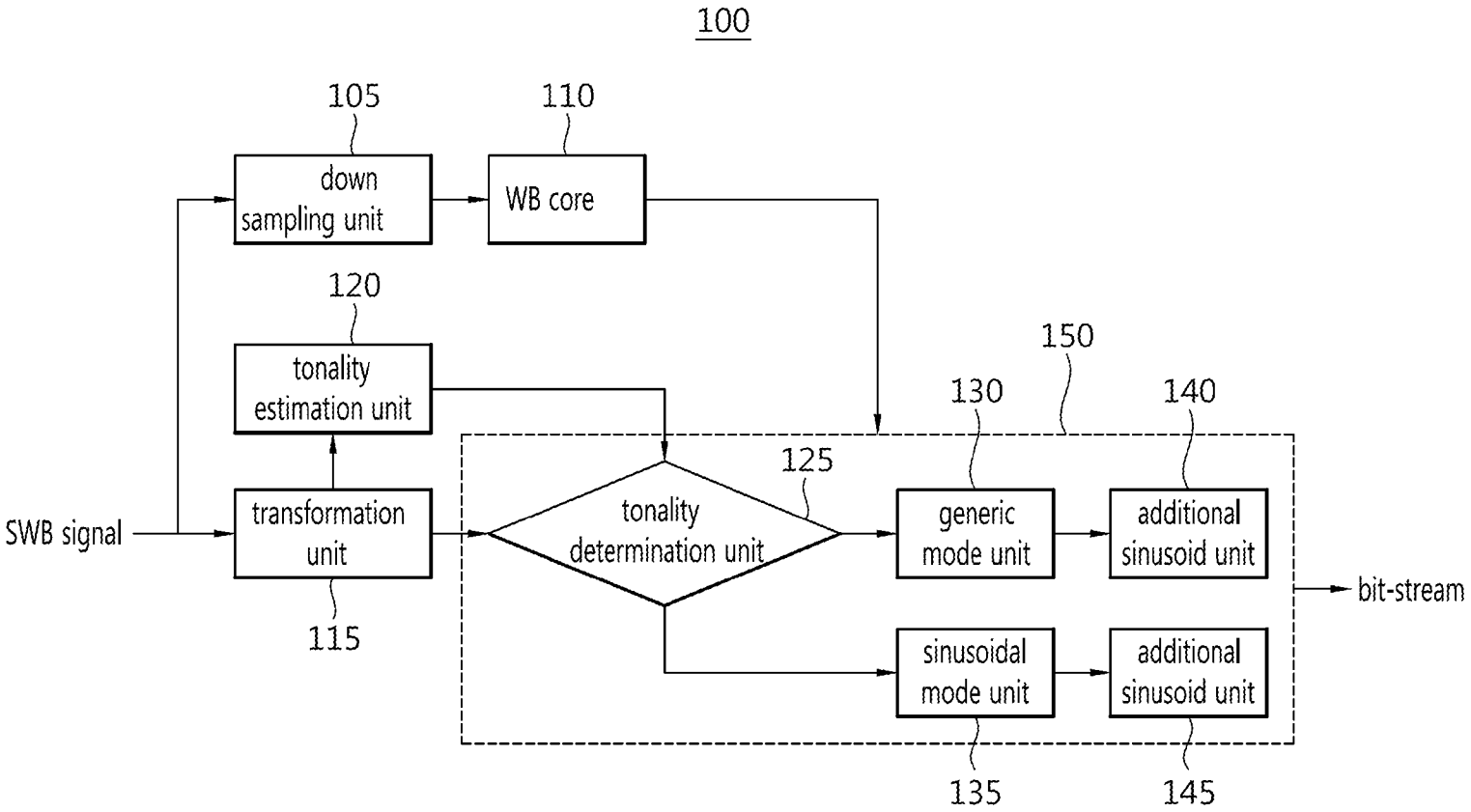
FIG. 1 is a schematic view showing an example of a structure of an encoder that can be used when an SWB signal is processed using a band extension method.

Hereinafter, exemplary embodiments of the present invention will be described in detail with reference to the accompanying drawings. In the following description of the exemplary embodiments of the present invention, well-known functions or constructions may not be described since they would obscure the invention in unnecessary detail.

When a constitutional element is mentioned as being "connected" to or "accessing" another constitutional element, this may mean that it is directly connected to or accessing the other constitutional element, but it is to be understood that there are no intervening constitutional elements present.

It will be understood that although the terms "first" and "second" are used herein to describe various elements, these elements should not be limited by these terms. These terms are only used to distinguish one element from another element.

Constitutional elements according to embodiments of the present invention are independently illustrated for the purpose of indicating specific separate functions, and this does not mean that the respective constitutional elements are constructed of separate hardware constitutional elements or one software constitutional element. The constitutional elements are arranged separately for convenience of explanation, and thus the function may be performed by combining at least two of the constitutional elements into one constitutional element, or by dividing one constitutional element into a plurality of constitutional elements.

To cope with a network development and a demand for a high-quality service, a method of processing an audio signal is under research with respect to various bands ranging from a narrow band (NB) to a wide band (WB) or a super wide band (SWB). For example, as a speech and audio coding/decoding technique, a code excited linear prediction (CELP) mode, a sinusoidal mode, or the like may be used.

An encoder may be divided into a baseline coder and an enhancement layer. The enhancement layer may be divided into a lower band enhancement (LBE) layer, a bandwidth extension (BWE) layer, and a higher band enhancement (HBE) layer.

The LBE layer performs coding/decoding on an excited signal, that is, a signal indicating a difference between a sound processed with a core encoder/core decoder and an original sound, thereby improving sound quality of a low band. Since a high-band signal has a similarity with respect to a low-band signal, a method of extending a high band by using a low band may be used to recover the high-band signal at a low bit rate.

As a method of recovering the high-band signal through coding and decoding by extending the signal, it is possible to consider a method of processing an SWB signal by performing scalable extension. A band extension method for the SWB signal may operate in a modified discrete cosine transform (MDCT) domain.

Extension layers may be processed in a divided manner in a generic mode and a sinusoidal mode. For example, in case of using three extension modes, a first extension layer may be processed in the generic mode and the sinusoidal mode, and second and third extension layers may be processed in the sinusoidal mode.

In the present specification, a sinusoid includes a sine wave and a cosine wave obtained by phase-shifting the sine wave by a half wavelength. Therefore, in the present invention, the sinusoid may imply the sine wave, or may imply the cosine wave. If an input sinusoid is the cosine wave, it may be transformed into the sine wave or the cosine wave in a coding/decoding process, and this transformation conforms to a transformation method applied to an input signal. Even if the input sinusoid is the sine wave, it may be transformed into the cosine wave or the sine wave in the coding/decoding process, and this transformation conforms to a transformation method applied to the input signal.

In the generic mode, coding is achieved on the basis of adaptive replication of a sub-band of a coded wideband signal. In coding of the sinusoidal mode, a sinusoid is added to high frequency contents.

In the sinusoidal mode, sign, amplitude, and position information may be coded for each sinusoid component, as an effective coding scheme for a signal having a strong periodicity or a signal having a tone component. A specific number of (e.g., 10) MDCT coefficients may be coded for each layer.

FIG. 1 is a schematic view showing an example of a structure of an encoder that can be used when an SWB signal is processed using a band extension method. In FIG. 1, a structure of an encoder of G.718 annex B scalable extension to which a sinusoidal mode is applied is described for example.

For SWB-extension, the encoder of FIG. 1 has a generic mode and a sinusoidal mode. When an additional bit is allocated, the sinusoidal mode may be used with extension.

Referring to FIG. 1, an encoder 100 includes a down-sampling unit 105, a WB core 110, a transformation unit 115, a tonality estimation unit 120, and an SWB encoder 150. The SWB encoder 150 includes a tonality determination unit 125, a generic mode unit 130, a sinusoidal mode unit 135, and additional sinusoid units 140 and 145.

When an SWB signal is input, the down-sampling unit 105 performs down-sampling on the input signal to generate a WB signal that can be processed by a core encoder.

SWB coding is performed in an MDCT domain. The WB core 110 performs MDCT on a WB signal synthesized by coding the WB signal, and outputs MDCT coefficients.

In MDCT, a time-domain signal is transformed into a frequency-domain signal. By using an overlap-addition scheme, an original signal can be perfectly reconstructed to a before-transformed signal. Equation 1 shows an example of the MDCT.

$$\alpha_r = \sum_{k=0}^{2N-1} \tilde{\alpha}_k \cos\left\{\pi \frac{[k+(N+1)/2](r+1/2)}{N}\right\}, \quad r = 0, \ldots, N-1 \qquad \text{< Equation 1 >}$$

$$\hat{\alpha}_k = \frac{2}{N}\sum_{k=0}^{N-1} \alpha_r \cos\left\{\frac{[k+(N+1)/2](r+1/2)}{N}\right\}, \quad k = 0, \ldots, 2N-1$$

$\tilde{a}_k = a_k \cdot w$ is a time-domain input signal subjected to windowing, and w is a symmetric window function. $\alpha_r$ is N MDCT coefficients. $\hat{a}_k$ is a recovered time-domain input signal having 2N samples.

The transformation unit 115 performs MDCT on an SWB signal. The tonality estimation unit 120 estimates a tonality of the MDCT-transformed signal. Which mode will be used between the generic mode and the sinusoidal mode may be determined on the basis of the tonality.

The tonality estimation may be performed on the basis of correlation analysis between spectral peaks in a current frame and a past frame. The tonality estimation unit 120 outputs a tonality estimation value to the tonality determination unit 125.

The tonality determination unit 125 determines whether the MDCT-transformed signal is a tonal on the basis of the tonality, and delivers a determination result to the generic mode unit 130 and the sinusoidal mode unit 135. For example, the tonality determination unit 125 may compare the tonality estimation value input from the tonality estimation unit 120 with a specific reference value to determine whether the MDCT-transformed signal is a tonal signal or an atonal signal.

As illustrated, the SWB encoder 150 processes an MDCT coefficient of the MDCT-transformed transformed SWB signal. In this case, the SWB encoder 150 may process the MDCT coefficient of the SWB signal by using an MDCT coefficient of a synthetic WB signal which is input via the core encoder 110.

If it is determined by the tonal determination unit 125 that the MDCT-transformed signal is not the tonal, the signal is delivered to the generic mode unit 130. If it is determined that the signal is the tonal, the signal is delivered to the sinusoidal mode unit 135.

The generic mode may be used when it is determined that an input frame is not the tonal. The generic mode unit 130 may transpose a low frequency spectrum directly to high frequencies, and may parameterize it to conform to an original high-frequency envelope. In this case, the parameterization may be achieved more coarsely than an original high-frequency case. By applying the generic mode, a high-frequency content may be coded at a low bit rate.

For example, in the generic mode, a high-frequency band is divided into sub-bands, and according to a specific similarity determination criterion, contents which are most similarly matched are selected among coded and envelope-normalized WB contents. The selected contents are subjected to scheduling and thereafter are output as synthesized high-frequency contents.

The sinusoidal mode unit 135 may be used when the input frame is the tonal. In the sinusoidal mode, a finite set of sinusoidal components is added to a high frequency (HF) spectrum to generate an SWB signal. In this case, the HF spectrum is generated by using an MDCT coefficient of an SWB synthetic signal.

When an additional bit is allocated, the additional sinusoid units 140 and 145 may be used to apply the sinusoidal mode with extension.

The additional sinusoid units 140 and 145 improve a generated signal by adding an additional sinusoid to a signal which is output in the generic mode and a signal which is output in the sinusoidal mode. For example, when an additional bit is allocated, the additional sinusoid units 140 and 145 improve a signal by extending the sinusoidal mode in which an additional sinusoid (pulse) to be transmitted is determined and quantized.

Meanwhile, as illustrated, outputs of the core encoder 110, the tonality determination unit 125, the generic mode unit 135, the sinusoidal mode unit 140, the additional sinusoid units 145 and 150 may be transmitted to a decoder as a bit-stream.

Figure 2:
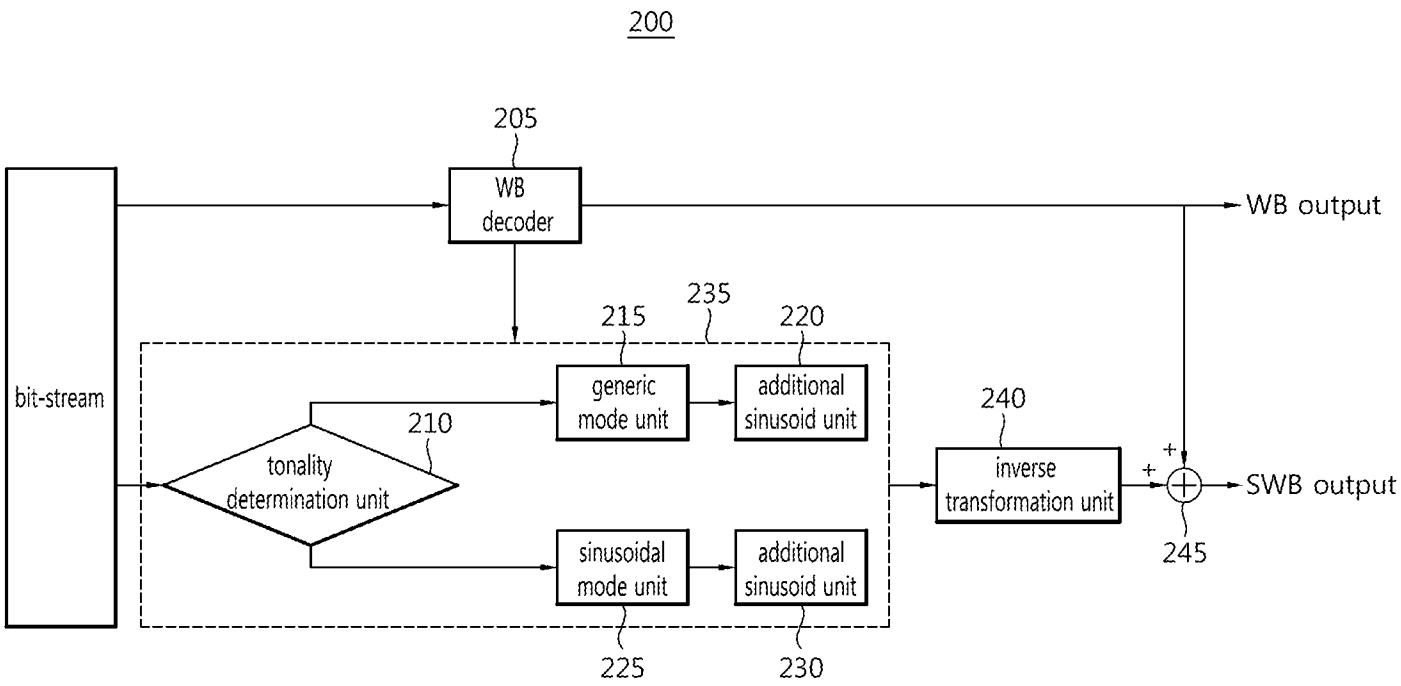
FIG. 2 is a schematic view showing an example of a structure of a decoder that can be used when an SWB signal is processed using a band extension method.

FIG. 2 is a schematic view showing an example of a structure of a decoder that can be used when an SWB signal is processed using a band extension method. In FIG. 2, a decoder of G.718 annex B SWB scalable extension is described as an example of the decoder used in the band extension of the SWB signal.

Referring to FIG. 2, a decoder 200 includes a WB decoder 205, an SWB decoder 235, an inverse transformation unit 240, and an adder 245. The SWB decoder 235 includes a tonality determination unit 210, a generic mode unit 215, a sinusoidal mode unit 225, additional sinusoid units 220 and 230.

In general, if a good frame (normal frame) is input, according to parsing information of a bit-stream, an SWB signal is synthesized via the SWB decoder 235.

A WB signal of the frame is synthesized by using an SWB parameter in the WB decoder 205.

A final SWB signal which is output in the decoder 200 is a sum of a WB signal which is output from the WB decoder 205 and a signal which is output via the SWB decoder 235 and the inverse transformation unit 240.

More specifically, target information to be processed and/or secondary information used for processing may be input from a bit-stream in the WB decoder 205 and the SWB decoder 235.

The WB decoder 205 decodes the WB signal to synthesize the WB signal. An MDCT coefficient of the synthesized WB signal may be input to the SWB decoder 235.

The SWB decoder 235 decodes MDCT of the SWB signal which is input from the bit-stream. In this case, an MDCT coefficient of a synthesized WB signal which is input from the WB decoder 205 may be used. Decoding of the SWB signal is performed mainly in an MDCT domain.

The tonality determination unit 210 may determine whether an MDCT-transformed signal is a tonal signal or an atonal signal. If the MDCT-transformed signal is determined as the tonal, an SWB-extended signal is synthesized in the generic mode unit 215, and if it is determined as the atonal, an SWB-extended signal (MDCT coefficient) may be synthesized by using sinusoid information in the sinusoidal mode unit 225. The generic mode unit 215 and the sinusoidal mode unit 225 decode a first layer of an extension layer. A higher layer may be decoded in the additional sinusoid units 235 and 230 by using an additional bit. For example, as to a layer 7 or a layer 8, the MDCT coefficient may be synthesized by using a sinusoid information bit of an additional sinusoidal mode.

The synthesized MDCT coefficients may be inverse-transformed in the inverse transformation unit 240, thereby generating an SWB-extended synthetic signal. In this case, synthesizing is performed according to layer information of an additional sinusoid block.

The adder 245 may output the SWB signal by adding the WB signal which is output from the WB decoder 205 and the SWB-extended synthetic signal which is output from the inverse transformation unit 240.

Meanwhile, if a loss occurs in a process of delivering coded audio information to the decoder, the loss may be recovered or concealed through forward error correction (FEC).

If an error occurs in a process of transmitting information, the error may be corrected or the loss may be compensated/concealed in case of FEC, unlike automatic repeat request (ARQ) in which information is retransmitted from a transmitting side by signaling whether to receive the information in a receiving side.

More specifically, in case of FEC, information capable of correcting an error or compensating/concealing a loss (information for error/loss correction) may be included in data transmitted from a transmitting side (encoder) or data stored in a storage medium. In a receiving side (decoder), the error/loss of the transmitted data or stored data may be recovered by using the information for error/loss correction. In this case, parameters of a previous good frame (normal frame), an MDCT coefficient, a coded/decoded signal, etc., may be used as the information for error/loss correction.

As described with reference to FIG. 1, an SWB bit-stream may consist of bit-streams of a WB signal and an SWB-extended signal. Since the bit-stream of the WB signal and the bit-stream of the SWB-extended signal consist of one packet, if one frame of an audio signal is lost, both of a bit of the WB signal and a bit of the SWB-extended signal are lost.

In this case, an FEC decoder may output the WB signal and the SWB-extended signal separately by applying FEC, similarly to a decoding operation for a good frame (normal frame), and thereafter may output an SWB signal for a lost frame by adding the WB signal and the SWB-extended signal.

If a current frame is lost, the FEC decoder may synthesize an MDCT coefficient for the lost current frame by using tonal information of a previous good frame of the current frame and the synthesized MDCT coefficient. The FEC decoder may output an SWB-extended signal by inverse-transforming the synthesized MDCT coefficient, and may decode an SWB signal for the lost current frame by adding the SWB-extended signal and the WB signal.

Figure 3:
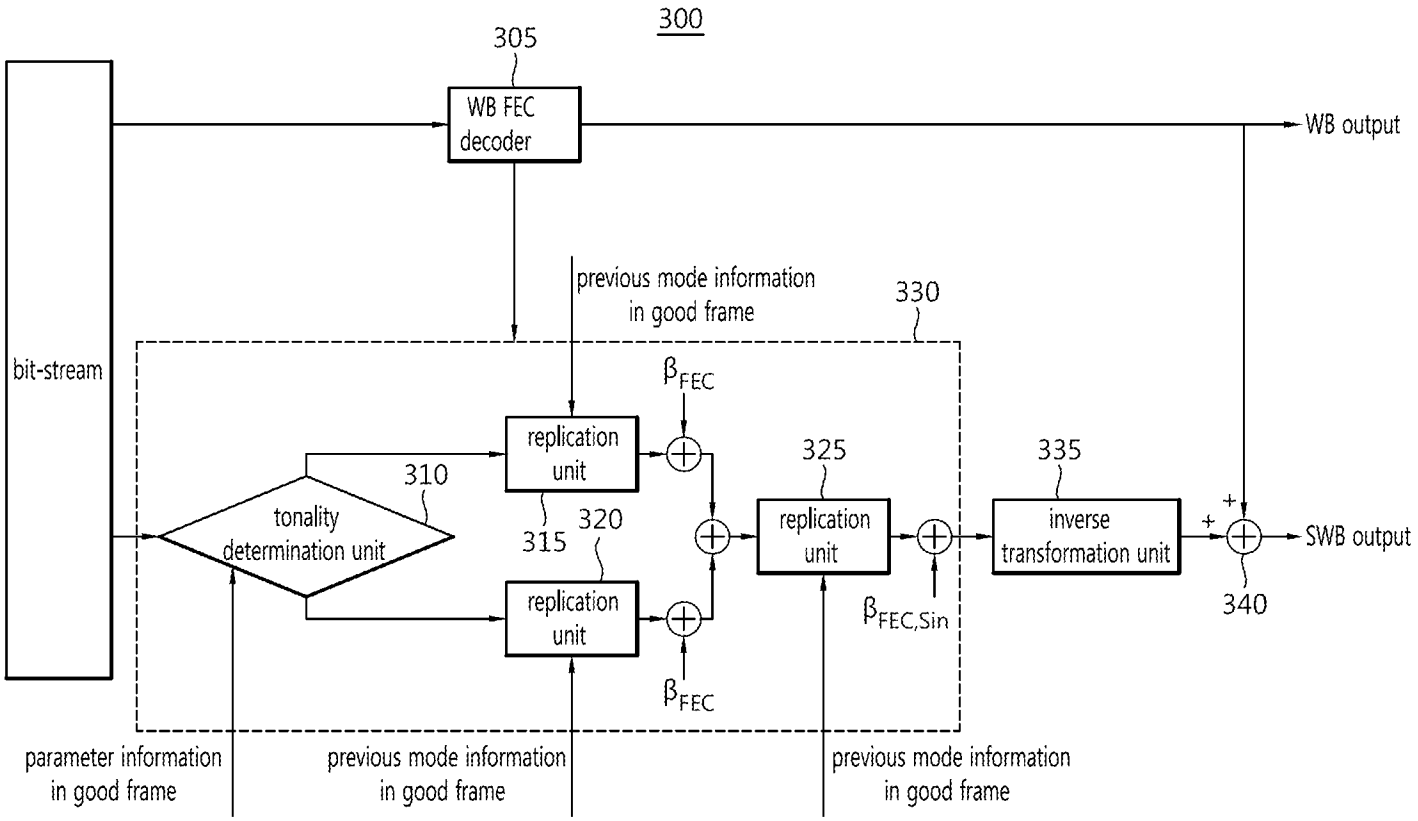
FIG. 3 is a block diagram for briefly explaining an example of a decoder that can be applied when a bit-stream containing audio information is lost in a communication environment.

FIG. 3 is a block diagram for briefly explaining an example of a decoder that can be applied when a bit-stream containing audio information is lost in a communication environment. More specifically, an example of a decoder capable of decoding a lost frame is shown in FIG. 3.

In FIG. 3, a FEC decoder of G.718 annex B SWB scalable extension is described as an example of the decoder that can be applied to the lost frame.

Referring to FIG. 3, an FEC decoder 300 includes a WB FEC decoder 305, an SWB FEC decoder 330, an inverse transformation unit 335, and an adder 340.

The WB FEC decoder 305 may decode a WB signal of the bit-stream. The WB FEC decoder 305 may perform decoding by applying FEC to a lost WB signal (MDCT coefficient of the WB signal). In this case, the WB FEC decoder 305 may recover an MDCT coefficient of a current frame by using information of a previous frame (good frame) of a lost current frame.

The SWB FEC decoder 330 may decode an SWB-extended signal of the bit-stream. The SWB FEC decoder 330 may perform decoding by applying FEC to a lost SWB-extended signal (MDCT coefficient of the SWB-extended signal). The SWB FEC decoder 330 may include a tonality determination unit 310 and replication units 315, 320, and 325.

The tonality determination unit 310 may determine whether the SWB-extended signal is a tonal.

An SWB-extended signal determined as a tonal (tonal SWB-extended signal) and an SWB-extended signal determined as an atonal (atonal SWB-extended signal) may be recovered through different processes. For example, the tonal SWB-extended signal may be subjected to the replication unit 315, and the atonal SWB-extended signal may be subjected to the replication unit 320, and thereafter the two signals may be added and then recovered through the replication unit 325.

In this case, a scaling factor applied to the tonal SWB-extended signal and a scaling factor applied to the atonal SWB-extended signal have different values. In addition, a scaling factor applied to an SWB-extended signal obtained by adding the tonal SWB-extended signal and the atonal SWB-extended signal may be different from a scaling factor applied to a tonal component and a scaling factor applied to an atonal component.

More specifically, in order to recover the SWB-extended signal, the SWB FEC decoder 330 may recover an IMDCT target signal (MDCT coefficient of the SWB-extended signal) so that inverse-transformation (IMDCT) is performed in the inverse transformation unit 335. The SWB FEC decoder 330 may apply a scaling coefficient according to a mode of a previous good frame (normal frame) of a lost frame (current frame) so that a signal (MDCT coefficient) of the good frame is linearly attenuated, thereby being able to recover MDCT coefficients for the SWB signal of the lost frame.

In this case, a lost signal can be recovered even if continuous frames are lost, by maintaining a linear attenuation as to a continuous frame loss.

According to whether a recovery target signal is a signal of a generic mode or a signal of a sinusoidal mode (whether it is a tonal signal or an atonal signal), different scaling coefficients may be applied. For example, a scaling factor $\beta_{FEC}$ may be applied to the generic mode, and a scaling factor $\beta_{FEC,sin}$ may be applied to the sinusoidal mode.

For example, if the current frame is lost, the previous frame which is a good frame is in the generic mode, and layers are present up to a layer 7, then it may be set to $\beta_{FEC}$=0.5 and $\beta_{FEC,sin}$=0.6 as a scaling factor for recovering the current frame (lost frame). In this case, an MDCT coefficient of the current frame (lost frame) may be recovered as shown in Equation 2.

$$\hat{M}_{32}(k)=0.5\hat{M}_{32,prev}(k)\ k=280,\ldots,559$$

$$\hat{M}_{32}(\mathrm{pos}_{FEC}(n))=0.6\hat{M}_{32,prev}(\mathrm{pos}_{FEC}(n))\quad n=0,\ldots,n_{FEC}-1 \qquad \text{<Equation 2>}$$

In Equation 2, $\hat{M}_{32}$ and $\hat{M}_{32,prev}$ are synthesized MDCT coefficients, and $\hat{M}_{32}$ denotes a magnitude of an MDCT coefficient of the current frame at a frequency k of an SWB band. $\hat{M}_{32,prev}$ denotes a magnitude of a synthesized MDCT coefficient in the previous frame and denotes a magnitude of an MDCT coefficient of the previous frame at a frequency k of an SWB band. $\mathrm{pos}_{FEC}(n)$ denotes a position corresponding to a wave number n in a signal recovered by applying FEC. $n_{FEC}$ denotes the number of MDCT coefficients recovered by applying FEC.

Further, if the current frame is lost, the previous frame which is a good frame (normal frame) is in the sinusoidal mode, and layers are present up to a layer 7, then it may be set to $\beta_{FEC}$=0 and $\beta_{FEC,sin}$=0.8 as a scaling factor for recovering the current frame (lost frame). In this case, an MDCT coefficient of the current frame (lost frame) may be recovered as shown in Equation 3.

$$\hat{M}_{32}(\mathrm{pos}_{FEC}(n))=0.8\hat{M}_{32,prev}(\mathrm{pos}_{FEC}(n))\quad n=0,\ldots,n_{FEC}-1 \qquad \text{<Equation 3>}$$

By generalizing Equation 2 and Equation 3, an MDCT coefficient for an SWB-extended signal for a lost frame may be recovered as shown in Equation 4.

$$\hat{M}_{32}(k)=\beta_{FEC}\hat{M}_{32,prev}(k)\ k=280,\ldots,559$$

$$\hat{M}_{32}(\mathrm{pos}_{FEC}(n))=\beta_{FEC,sin}\hat{M}_{32,prev}(\mathrm{pos}_{FEC}(n))\quad n=0,\ldots,n_{FEC}-1 \qquad \text{<Equation 4>}$$

Meanwhile, in the aforementioned FEC method, if the current frame is lost, a lost signal is recovered by using only an MDCT coefficient of the previous frame (past frame) under the assumption that an MDCT coefficient is linearly attenuated. In case of applying this method, a signal can be effectively recovered if a loss occurs in a duration in which an energy of the signal is gradually attenuated. However, if the energy of the signal is increased or the signal is in a normal state (a state in which a magnitude of the energy is maintained within a specific range), a sound quality distortion occurs.

Further, the aforementioned FEC method may show a good performance in a communication environment where a lost frame has a small loss rate at which one or two frames are lost during a good frame (normal frame). Unlike this, if continuous frames are lost (if a loss occurs frequently) or a duration in which the loss occurs is long, a sound quality loss may significantly occur even in a recovered signal.

By considering the aforementioned aspects, the present invention may adaptively apply scaling factors by using not only transform coefficients (MDCT coefficients) of one frame among previous good frames of the current frame (lost frame) but also a degree of changes in the previous good frames of the current frame.

Further, instead of applying the same scaling factor to the SWB-extended band as described above, the present invention may consider that an MDCT feature differs for each band. For example, the present invention may modify a scaling factor for each band by considering a degree of changes of the previous good frames of the current frame (lost frame). Therefore, a change of the MDCT coefficient may be considered in the scaling factor for each band.

A method of applying the present invention may be classified briefly as described below in (1) and (2).

(1) If a single frame is lost.—Since the present invention is also applied to a case where a time-axis signal is transformed into another-axis (e.g., frequency-axis) signal such as MDCT or fast Fourier transform (FFT), a frame loss in an upper SWB side can be effectively recovered or concealed in the SWB decoder structure of G.718 shown in FIG. 2 or FIG. 3.

When a single frame is lost, a method of concealing the frame loss may roughly include three steps (i) to (iii) as follows: (i) determining whether a received frame is lost; (ii) if the received frame is lost, recovering a transform coefficient for a lost frame from transform coefficients for previous good frames; and (iii) inverse-transforming the recovered transform coefficient.

For example, in a case where the frame loss is confirmed, in the step of recovering the transform coefficient, if an $n^{th}$ frame is lost, a transform coefficient for the $n^{th}$ frame can be recovered from stored transform coefficients as a transform coefficient for previous frames ($(n-1)^{th}$ frame, $(n-2)^{th}$ frame, . . . , $(n-N)^{th}$ frame). Herein, N denotes the number of frames used in a loss concealment process. Next, the frame loss may be concealed by performing inverse-transformation (IMDCT) on a transform coefficient (MDCT coefficient) for the recovered $n^{th}$ frame.

In this case, in the step of recovering the transform coefficient, an attenuation constant (scaling factor) may vary for each band. Further, whether there is a tonal component of good frames (lossless frames) is estimated, and the attenuation constant may vary depending on a presence/absence of the tonal component.

For example, in case of a band having a strong tonal component, an attenuation component to be used for recovering a transform coefficient of a lost frame may be derived by using correlation information of sinusoidal pulses (MDCT coefficients) in previous frames. In case of a band having no or weak tonal component, an attenuation constant to be used for recovering a transform coefficient of a lost frame may be derived by estimating energy information of transform coefficients (MDCT coefficients) for previous good frames (normal frames).

The recovered transform coefficient, tonal information of each band, and an attenuation constant may be stored for loss recovery (concealment) for a case where a frame is lost continuously.

(2) If continuous frames are lost.—A method of concealing a loss when continuous frames are lost may roughly include two steps (a) and (b) as follows: (a) determining whether continuous frames are lost with respect to a received frame; and (b) if the continuous frames are lost, recovering an exited signal (MDCT coefficient) with respect to continuously lost frames by using transform coefficients of previous good frames (lossless frames).

Even if the continuous frames are lost, an additional attenuation constant (scaling factor) to be applied for each band may be changed according to a presence/absence of a tonal component or a strength/weakness of the tonal component for each band.

Figure 4:
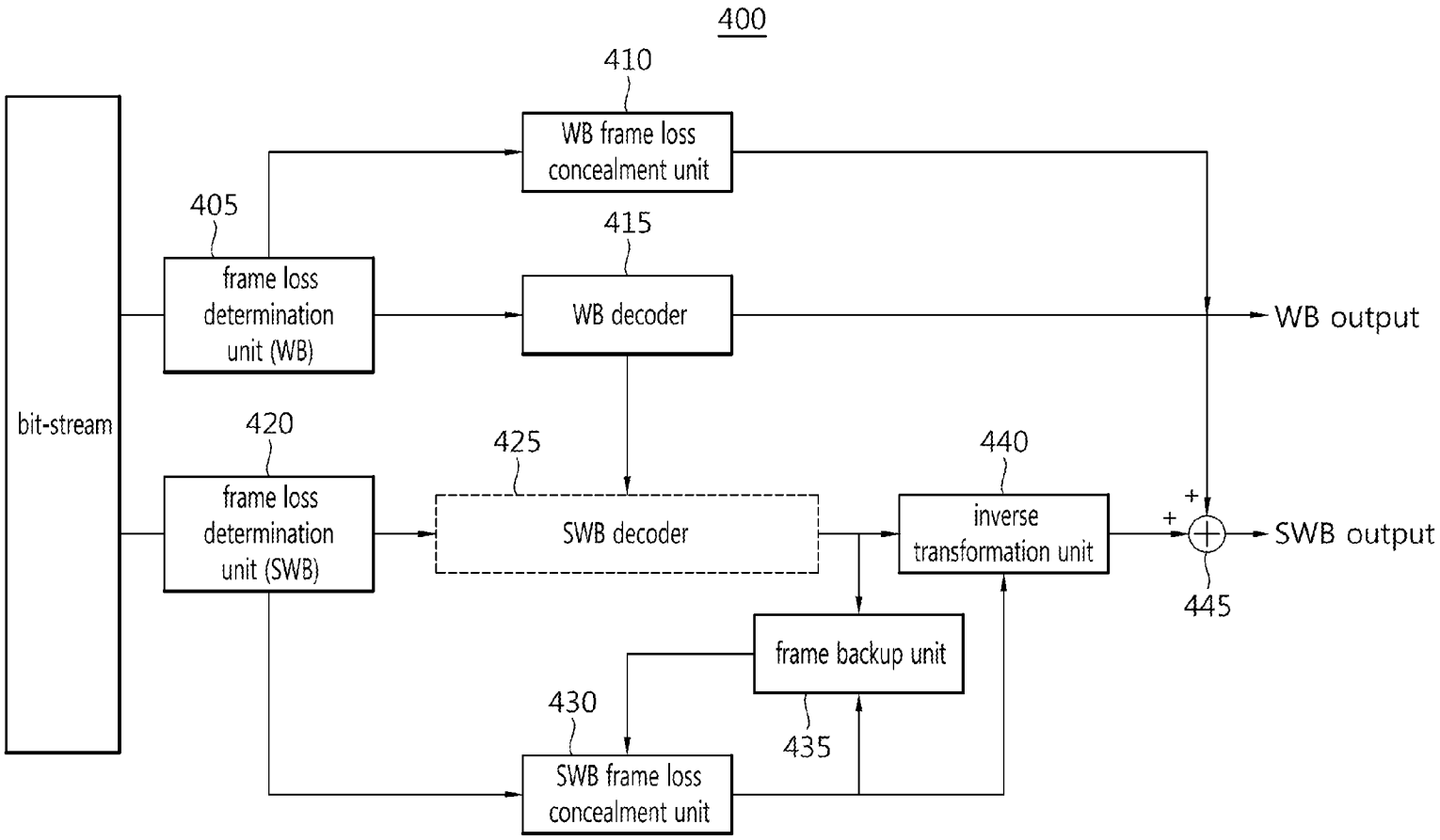
FIG. 4 is a block diagram for briefly explaining an example of a decoder applied to conceal a frame loss according to the present invention.

FIG. 4 is a block diagram for briefly explaining an example of a decoder applied to conceal a frame loss according to the present invention.

Referring to FIG. 4, a decoder 400 includes a frame loss determination unit 405 for a WB signal, a frame loss concealment unit 410 for the WB signal, a decoder 415 for the WB signal, a frame loss determination unit 420 for an SWB signal, a decoder 425 for the SWB signal, a frame loss concealment unit 430 for the SWB signal, a frame backup unit 435, an inverse transformation unit 440, and an adder 445.

The frame loss determination unit 405 determines whether there is a frame loss for the WB signal. The frame loss determination unit 420 determines whether there is a frame loss for the SWB signal. The frame loss determination units 405 and 420 may determine whether a loss occurs in a single frame or in continuous frames.

Although the frame loss determination unit 405 for the WB signal and the frame loss determination unit 420 for the SWB signal are described as separate operation elements herein, the present invention is not limited thereto. For example, the decoder 400 may include one frame loss unit, and the frame loss unit may determine both of the frame loss for the WB signal and the frame loss for the SWB signal. Alternatively, since it is expected that both of the WB signal and the SWB signal are lost when a frame loss occurs, the frame loss for the WB signal may be determined and thereafter a determination result may be applied to the SWB signal, or the frame loss for the SWB signal may be determined and thereafter a determination result may be applied to the WB signal.

As to a frame of a WB signal which is determined as having a loss, the frame loss concealment unit 410 conceals the frame loss. The frame loss concealment unit 410 may recover information of a frame (current frame) in which a loss occurs on the basis of previous good frame (normal frame) information.

As to a frame of a WB signal which is determined as not having a loss, the WB decoder 415 may perform decoding of the WB signal.

Signals decoded or recovered for the WB signal may be delivered to the SWB decoder 425 for decoding or recovery of the SWB signal. Further, the signals decoded or recovered for the WB signal may be delivered to the adder 445, thereby being used to synthesize the SWB signal.

Meanwhile, as to a frame of an SWB signal determined as not having a loss, the SWB decoder 425 may perform decoding of an SWB-extended signal. In this case, the SWB decoder 425 may decode the SWB-extended signal by using the decoded WB signal.

As to an SWB signal determined as having a loss, the SWB frame loss concealment unit 430 may recover or conceal the frame loss.

If there is a loss in a single frame, the SWB frame loss concealment unit 430 may recover a transform coefficient of a current frame by using a transform coefficient of previous good frames stored in the frame backup unit 435. If there is a loss in continuous frames, the SWB frame loss concealment unit 430 may store transform coefficients for the current frame (lost frame) by using information (e.g., per-band tonal information, per-band attenuation constant information, etc.) used for recovery of not only transform coefficients of previous recovered lost frames and transform coefficients of good frames (normal frames) but also transform coefficients of previous lost frames.

A transform coefficient (MDCT coefficient) recovered in the SWB loss concealment unit 430 may be subjected to inverse-transformation (IMDCT) in the inverse transformation unit 440.

The frame backup unit 435 may store transform coefficients (MDCT coefficients) of the current frame. The frame backup unit 435 may delete previously stored transform coefficients (transform coefficients of a previous frame), and may store the transform coefficients for the current frame. When there is a loss in a very next frame, the transform coefficients for the current frame may be used to conceal the loss.

Unlike this, the frame backup unit 435 may have N buffers (where N is an integer), and may store transform coefficients of frames. In this case, frames included in a buffer may be a good frame (normal frame) and a frame recovered from a loss.

For example, the frame backup unit 435 may delete transform coefficients stored in an $N^{th}$ buffer, and may shift transform coefficients of frames stored in each buffer to a very next buffer one by one and thereafter store transform coefficients for the current frame into a $1^{st}$ buffer. In this case, the number of buffers, N, may be determined by considering a decoder performance, audio quality, etc.

The inverse transformation unit 440 may generate an SWB-extended signal by inverse-transforming a transform coefficient decoded in the decoder 425 and a transform coefficient recovered in the SWB frame loss concealment unit 430.

The adder 445 may add a WB signal and an SWB-extended signal to output an SWB signal.

Figure 5:
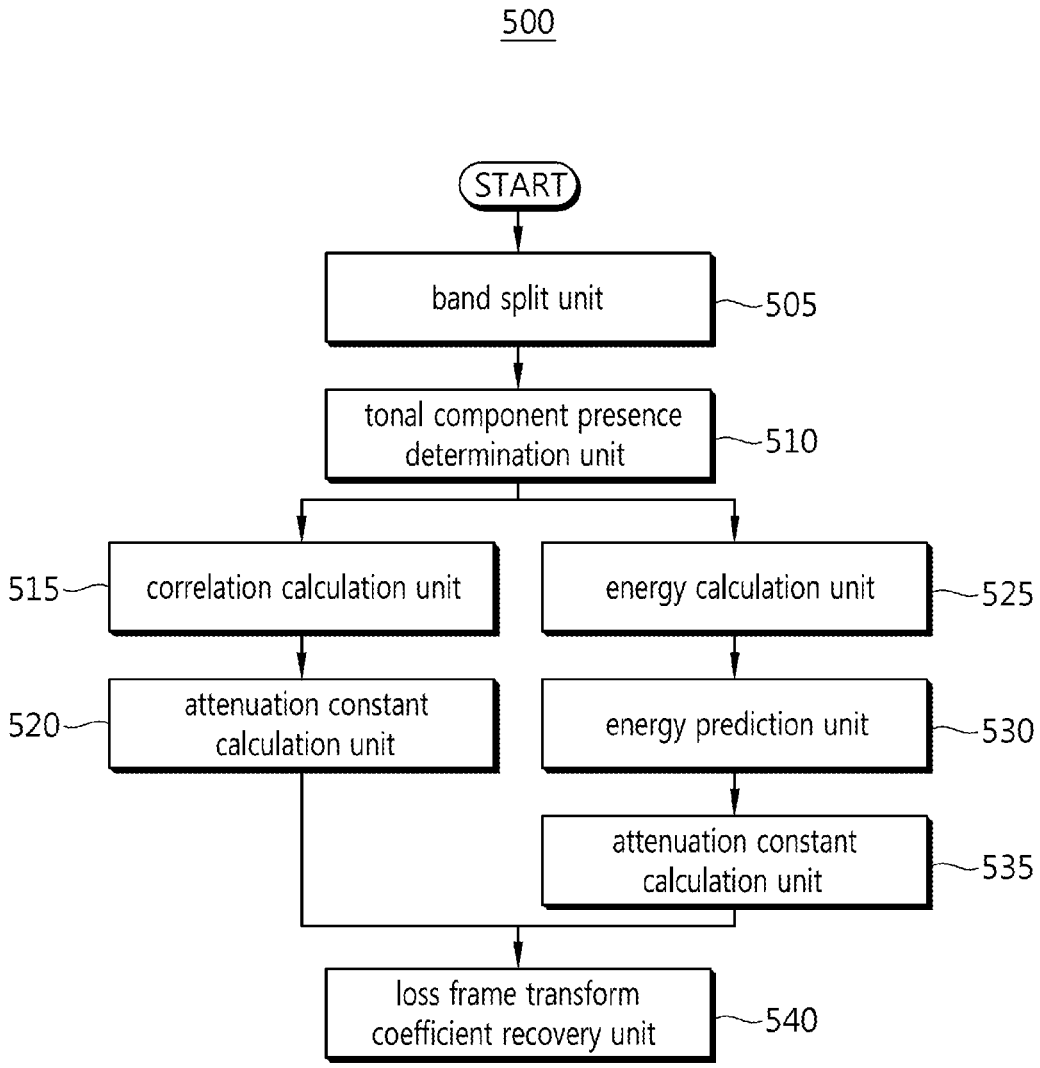
FIG. 5 is a block diagram for briefly explaining an example of a frame loss concealment unit according to the present invention.

FIG. 5 is a block diagram for briefly explaining an example of a frame loss concealment unit according to the present invention. In FIG. 5, a frame loss concealment unit for a case where a single frame is lost is described for example.

When the single frame is lost, as described above, the frame loss concealment unit may recover a transform coefficient of the lost frame by using information regarding transform coefficients of a previous good frame (normal frame) stored in a frame backup unit.

Referring to FIG. 5, a frame loss concealment unit 500 includes a band split unit 505, a tonal component presence determination unit 510, a correlation calculation unit 515, an attenuation constant calculation unit 520, an energy calculation unit 525, an energy prediction unit 530, an attenuation constant calculation unit 535, and a loss frame transform coefficient recovery unit 540.

In frame loss concealment/recovery according to the present invention, an MDCT coefficient may be recovered by considering a feature of the per-band MDCT coefficient. More specifically, in the frame loss/concealment, an MDCT coefficient for a lost frame may be recovered by applying a change rate (attenuation constant) which differs for each band.

Therefore, in the frame loss concealment unit 500, the band split unit 505 performs grouping on transform coefficients of a previous good frame (normal frame) stored in a buffer into M bands (M groups). The band split unit 505 allows continuous transform coefficients to belong to one band when performing grouping, thereby obtaining an effect of splitting the transform coefficients of the good frame for each frequency band. For example, the M groups correspond to the M bands.

The tonal component presence determination unit 510 analyzes an energy correlation of spectral peaks in a log domain by using transform coefficients stored in N buffers ($1^{st}$ to $N^{th}$ buffers), thereby being able to calculate a tonality of the transform coefficients for each band. That is, the tonal component presence determination unit 510 calculates a tonality for each band, thereby being able to determine a presence of a tonal component for each band. For example, if a lost frame is a $n^{th}$ frame, a tonality for M bands of the $n^{th}$ frame (lost frame) may be derived by using transform coefficients of previous frames ($(n-1)^{th}$ frame to $(n-N)^{th}$ frame) stored in N buffers.

According to a result of determining the tonality of the lost frame for each band, bands having many tonal components may be recovered by using an attenuation constant derived through the correlation calculation unit 515 and the attenuation constant calculation unit 520.

According to the result of determining the tonality of the lost frame for each band, bands having no or small tonal components may be recovered by using an attenuation constant derived through the energy calculation unit 525, the energy prediction unit 530, and the attenuation constant calculation unit 535.

More specifically, the correlation calculation unit 515 for transform coefficients of a lossless frame may calculate a correlation for a band (e.g., an $m^{th}$ band) determined as being a tonal in the tonal component presence determination unit 510. That is, in a band determined as having a tonal component, the correlation calculation unit 515 measures a correlation of a position between pulses of previous continuous good frames ($(n-1)^{th}$ frame, . . . , $(n-N)^{th}$ frame) of a current frame (lost frame) which is an $n^{th}$ frame, thereby being able to determine the correlation.

Regarding frames having a strong correlation in continuous good frames, a correlation determination may be performed under the premise that a position of a pulse (MDCT coefficient) is located in the range of ±L from an important MDCT coefficient or a great MDCT coefficient.

The attenuation constant calculation unit 520 may adaptively calculate an attenuation constant for a band having many tonal components on the basis of the correlation calculated in the correlation calculation unit 515.

Meanwhile, the energy calculation unit 525 for frames of a lossless frame may calculate an energy for a band having no or small tonal components. The energy calculation unit 525 may calculate a per-band energy for the previous good frames of the current frame (lost frame). For example, if the current frame (lost frame) is an $n^{th}$ frame and information on N previous frames is stored in N buffers, the energy calculation unit 525 may calculate a per-band energy for frames from an $(n-1)^{th}$ frame to an $(n-N)^{th}$ frame. In this case, a band in which an energy is calculated may be bands belonging to a band determined as having no or small tonal components by the tonal component presence determination unit 510.

The energy prediction unit 606 may perform estimation by linearly predicting an energy of the current frame (lost frame) on the basis of a per-band energy calculated for each frame from the energy calculation unit 525.

The attenuation constant calculation unit 535 may derive an attenuation constant for a band having no or small tonal components on the basis of a prediction value of the energy calculated in the energy prediction unit 530.

In other words, as to a band having many tonal components, the attenuation constant calculation unit 520 may derive the attenuation constant on the basis of a correlation between transform coefficients of lossless frames calculated in the correlation calculation unit 515. Further, as to a band having no or small tonal components, the energy prediction unit 530 may derive an attenuation constant on the basis of a ratio between an energy of the current frame (lost frame) predicted in the energy prediction unit 530 and an energy of a previous good frame. For example, if the current frame (lost frame) is an $n^{th}$ frame, a ratio between a value predicted as an energy of the $n^{th}$ frame and an energy of an $(n-1)^{th}$ frame (an energy of $(n-1)^{th}$ frame/an energy prediction value of $n^{th}$ frame) may be derived as an attenuation constant to be applied to the $n^{th}$ frame.

The transform coefficient recovery unit 540 for the lost frame may recover a transform coefficient of the current frame (lost frame) by using the attenuation constant (scaling factor) calculated in the attenuation constant calculation units 520 and 535 and transform coefficients of a previous good frame of the current frame.

The operation performed in the frame loss concealment unit of FIG. 5 is described in greater detail with reference to the accompanying drawings.

Figure 6:
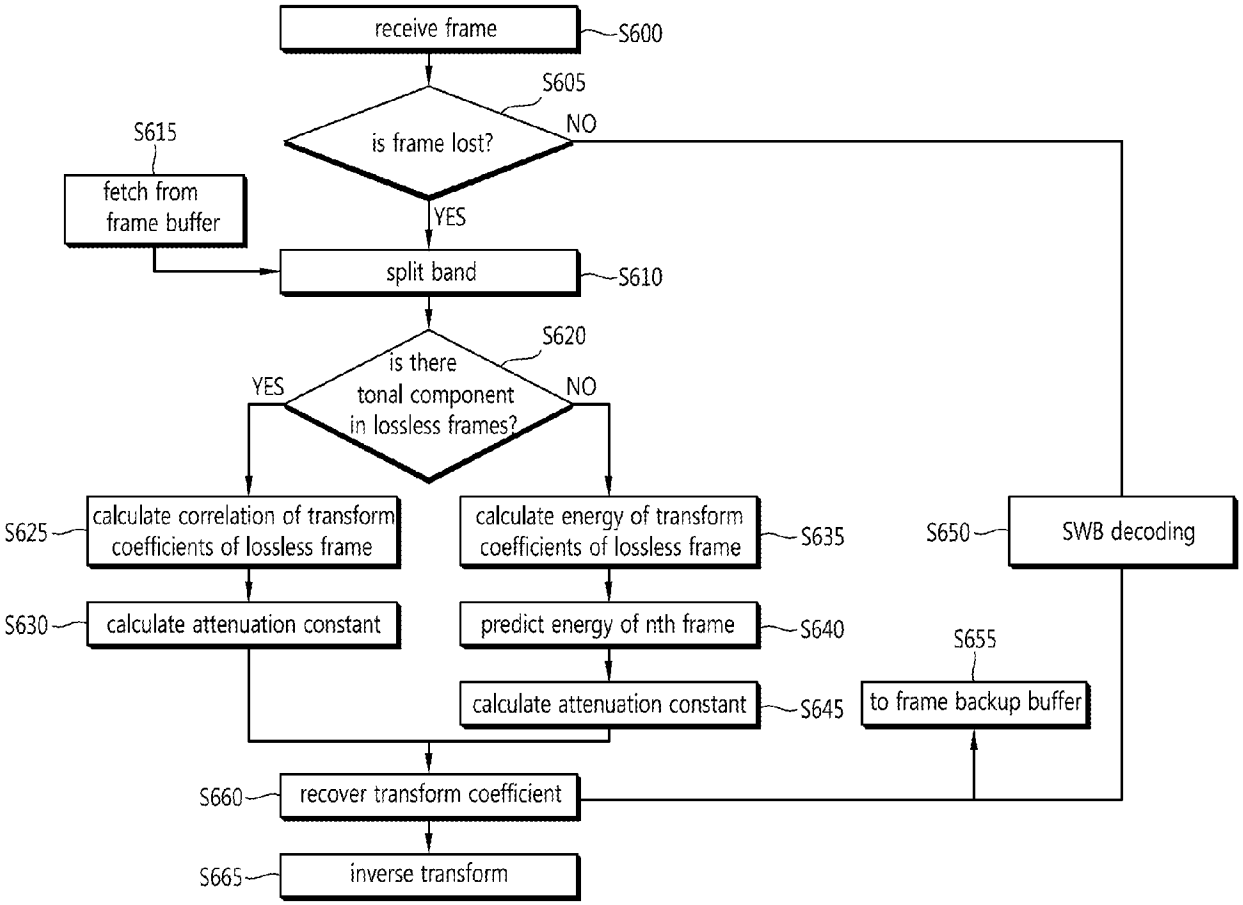
FIG. 6 is a flowchart for briefly explaining an example of a method of concealing/recovering a frame loss in a decoder according to the present invention.

FIG. 6 is a flowchart for briefly explaining an example of a method of concealing/recovering a frame loss in a decoder according to the present invention. In FIG. 6, a frame loss concealment method applied when a single frame is lost is described for example. An operation of FIG. 6 may be performed in an audio signal decoder or a specific operation unit in the decoder. For example, referring to the description of FIG. 5, the operation of FIG. 6 may also be performed in the frame loss concealment unit of FIG. 5. However, for convenience of explanation, it is described herein that the decoder performs the operation of FIG. 6.

Referring to FIG. 6, the decoder receives a frame including an audio signal (step S600). The decoder determines whether there is a frame loss (step S650).

If the received frame is determined as a good frame, SWB decoding may be performed by an SWB decoder (step S650). If it is determined that the frame loss exists, the decoder performs frame loss concealment.

More specifically, if it is determined that there is a frame loss, the decoder fetches transform coefficients for a stored previous good frame from a frame backup buffer (step S615), and splits them into M bands (where M is an integer) (step S610). The band split is the same as that described above.

The decoder determines whether there is a tonal component of lossless frames (good frames) (step S620). For example, if a current frame (lost frame) is an $n^{th}$ frame, how many tonal components there are for each band may be determined by using transform coefficients grouped into M bands of an $(n-1)^{th}$ frame, an $(n-2)^{th}$ frame, . . . , an $(n-N)^{th}$ frame which are previous frames of the current frame. In this case, N is the number of buffers for storing transform coefficients of a previous frame. If the number of buffers is N, transform coefficients for N frames may be stored.

A tonality may be determined on the basis of a spectrum similarity in a log axis by using a per-band transform coefficient of good frames ($(n-1)^{th}$ frame, $(n-2)^{th}$ frame, . . . , $(n-N)^{th}$ frame). For example, in case of grouping the transform coefficient into three bands (M=3), transform coefficients of previous good frames of the current frame are classified into 3 bands, and a tonality may vary for each band. For example, it may be determined that a first band has a tonal component, a second band does not have a tonal component, and a third band has a tonal component.

As such, the tonality may be determined differently for each band, and a per-band attenuation constant may be derived by using different methods according to the tonality.

For example, if it is determined that there are many tonal components, a correlation between transform coefficients of a lossless frame (good frame) is calculated (step S625), and an attenuation constant may be calculated on the basis of the calculated correlation (step S630).

More specifically, the decoder may calculate a correlation between transform coefficients of the lossless frame (good frame) by using a signal obtained by performing band split on transform coefficients (MDCT coefficients) stored in a frame backup buffer (step S625). The correlation calculation may be performed only for a band determined as having a tonal component in step S620.

The step of calculating the correlation of the transform coefficients (step S625) is for measuring a harmonic having a great continuity in a band having a strong tonality, and uses an aspect that a position of a sinusoidal pulse of a transform coefficient is not significantly changed in continuous good frames.

That is, a correlation may be calculated for each band by measuring a positional correlation of sinusoidal pulses of the continuous good frames. In this case, K transform coefficients having a great magnitude (great absolute value) may be selected as a sinusoidal pulse for calculating the correlation.

The per-band correlation may be calculated by using Equation 5.

$$\text{per-band correlation} = W_m \times \sum_{band_start}^{band_end} (N_{i,n-1} \times N_{i,n-2}) \quad \text{< Equation 5 >}$$

Herein, $W_m$ denotes a weight for an $m^{th}$ band. The weight may be allocated such that the lower the frequency band, the greater the value. Therefore, a relation of $W_1 \geq W_2 \geq W_3 \ldots$ may be established. In Equation 5, $W_m$ may have a value greater than 1. Therefore, Equation 5 may also be applied when a signal is increased for each frame.

In Equation 5, $N_{i,n-1}$ denotes an $i^{th}$ sinusoidal pulse of an $(n-1)^{th}$ frame, and denotes an $i^{th}$ sinusoidal pulse of an $(n-2)^{th}$ frame.

In Equation 5, for convenience of explanation, a case where only previous two good frames ($(n-1)^{th}$ good frame and $(n-2)^{th}$ good frame) of a current frame (lost frame) are considered is described.

Figure 7:
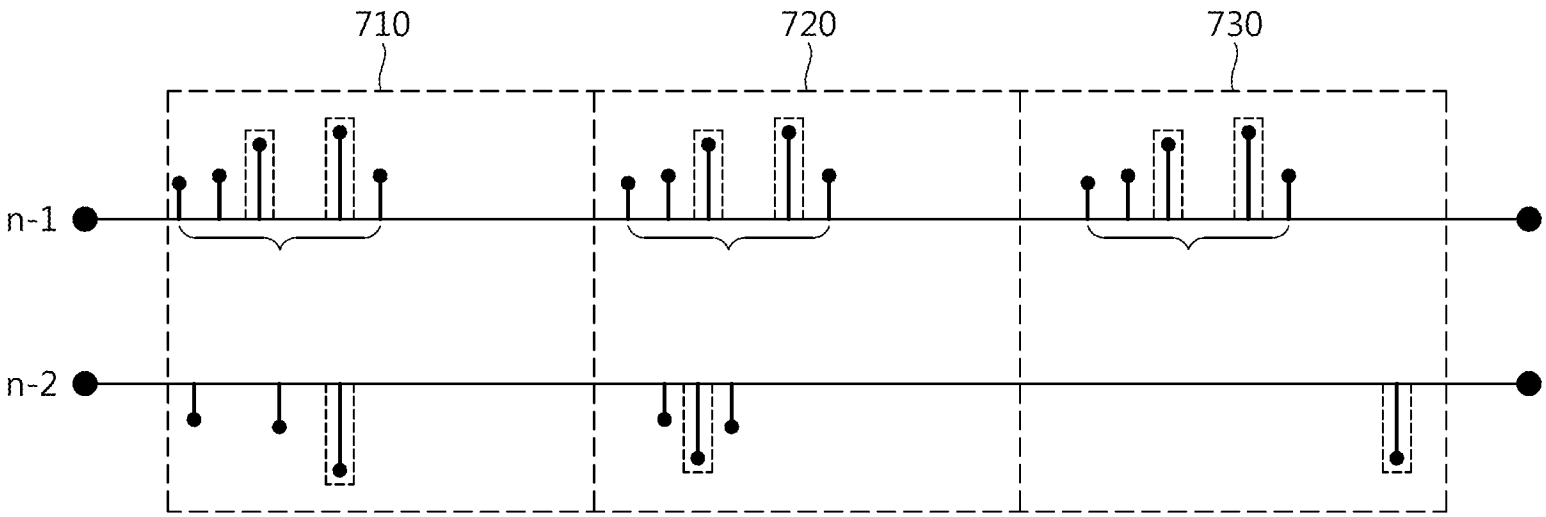
FIG. 7 is a diagram for briefly explaining an operation of deriving a correlation according to the present invention.

FIG. 7 is a diagram for briefly explaining an operation of deriving a correlation according to the present invention.

For convenience of explanation, in FIG. 7, a case where a transform coefficient is grouped into three bands in two good frames ($(n-1)^{th}$ frame and $(n-2)^{th}$ frame) is described for example.

It is assumed in the example of FIG. 7 that a band 1 and a band 2 are bands having a tonality. In this case, a correlation may be calculated by Equation 5.

By using Equation 5, in case of the band 1, since a pulse having a great magnitude has a similar position in an $(n-1)^{th}$ frame and an $(n-2)^{th}$ frame, a correlation of a great value is calculated. Unlike this, in case of the band 1, since a pulse having a great magnitude has a different position in an $(n-1)^{th}$ frame and an $(n-2)^{th}$ frame, a correlation of a small value is calculated.

Returning to FIG. 6, the decoder may calculate an attenuation constant on the basis of the calculated correlation (step S630). A maximum value of the correlation is less than 1, and thus the decoder may derive the per-band correlation as the attenuation constant. That is, the decoder may use the per-band correlation as the attenuation constant.

As described in steps S625 and S630, according to the present invention, the attenuation constant may be adaptively calculated on the basis of an inter-pulse correlation calculated for a band having a tonality.

Meanwhile, as to a band having small or no totality, the decoder may calculate an energy of transform coefficients of a lossless frame (good frame) (step S635), may predict an energy of an $n^{th}$ frame (current frame, lost frame) on the basis of the calculated energy (step S640), and may calculate an attenuation constant by using the predicted energy of the lost frame and the energy of the good frame (step S645).

More specifically, as to the band having small or no tonality, the decoder may calculate a per-band energy for previous good frames of the current frame (lost frame) (step S635). For example, if the current frame is an $n^{th}$ frame, the per-band energy may be calculated for an $(n-1)^{th}$ frame, an $(n-2)^{th}$ frame, . . . , an $(n-N)^{th}$ frame (where N is the number of buffers).

The decoder may predict the energy of the current frame (lost frame) on the basis of the calculated energy of the good frame (step S640). For example, the energy of the current frame may be predicted by considering a per-frame energy change amount as to previous good frames.

The decoder may calculate an attenuation constant by using an inter-frame energy ratio (step S645). For example, the decoder may calculate the attenuation constant through a ratio between the predicted energy of a current frame ($n^{th}$ frame) and an energy of a previous frame ($(n-1)^{th}$ frame). If an energy is denoted by $E_{n,pred}$ and an energy in the previous frame of the current frame is $E_{n-1}$, an attenuation constant for a band having small or no totality of the current frame may be $E_{n,pred}/E_{n-1}$.

The decoder may recover a transform coefficient of the current frame (lost frame) by using the attenuation constant calculated for each band (step S660). The decoder may recover the transform coefficient of the current frame by multiplying the attenuation constant calculated for each band by a transform coefficient of a previous good frame of the current frame. In this case, since the attenuation constant is derived for each band, it is multiplied by transform coefficients of a corresponding band among bands constructed of transform coefficients of the good frame.

For example, the decoder may derive transform coefficients of a $k^{th}$ band of an $n^{th}$ frame (lost current frame) by multiplexing an attenuation constant for the $k^{th}$ band by transform coefficients in the $k^{th}$ band of an $(n-1)^{th}$ frame (where k and n are integers). The decoder may recover transform coefficients of an $n^{th}$ frame (current frame) for all bands by multiplexing a corresponding attenuation constant for each band of the $(n-1)^{th}$ frame.

The decoder may output an SWB-extended signal by inverse-transforming a recovered transform coefficient and a decoded transform coefficient (step S665). The decoder may output the SWB-extended signal by inverse-transforming (IMDCT) a transform coefficient (MDCT coefficient). The decoder may output an SWB signal by adding the SWB-extended signal and a WB signal.

Meanwhile, the transform coefficient recovered in step S660, information indicating a presence/absence of a tonal component determined in step S620, and information such as the attenuation constant calculated in steps S630 and S645 may be stored in a frame backup buffer (step S655). When a frame is lost at a later time, the stored transform coefficient may be used to recover a transform coefficient of the lost frame. For example, if continuous frames are lost, the decoder may recover continuous lost frames by using stored recovery information (a transform coefficient recovered in a previous frame, tonal component information regarding previous frames, an attenuation constant, etc.).

Figure 8:
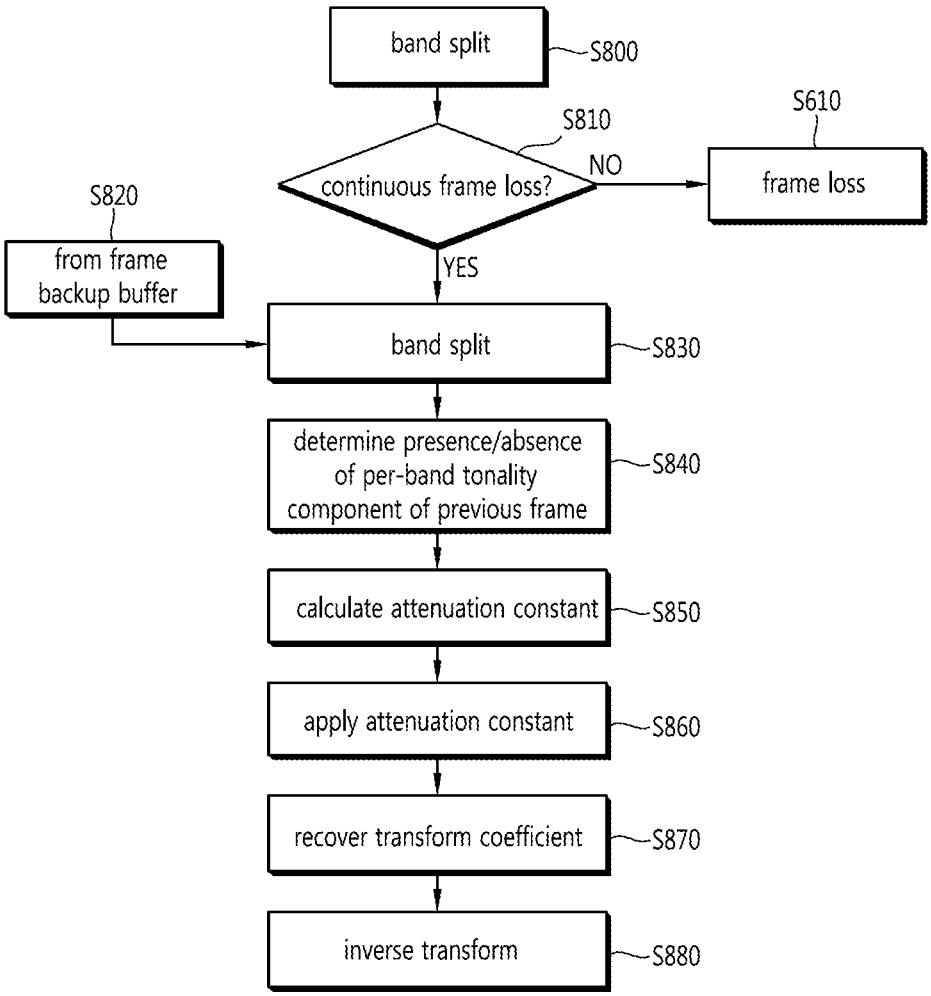
FIG. 8 is a flowchart for briefly explaining an example of a method of concealing/recovering a frame loss in a decoder according to the present invention.

FIG. 8 is a flowchart for briefly explaining an example of a method of concealing/recovering a frame loss in a decoder according to the present invention. In FIG. 8, a frame loss concealment method applied when continuous frames are lost is described for example. An operation of FIG. 8 may be performed in an audio signal decoder or a specific operation unit in the decoder. For example, referring to the description of FIG. 5, the operation of FIG. 8 may also be performed in the frame loss concealment unit of FIG. 5. However, for convenience of explanation, it is described herein that the decoder performs the operation of FIG. 8.

Referring to FIG. 8, the decoder determines whether there is a frame loss for a current frame (step S800).

When there is a frame loss, the decoder determines whether the loss occurs in continuous frames (step S810). If the current frame is lost, the decoder may determine whether the loss occurs in the continuous frames by deciding whether a previous frame is also lost.

If the previous frame is a good frame (if a single frame is lost), the decoder may sequentially perform the band split step (step S610) and its subsequent steps described in FIG. 6.

If it is determined that the frame loss also occurs in the previous frame and thus it is determined that continuous frames are lost, the decoder may fetch information from a frame backup buffer (step S820), and may spit it into M bands (where M is an integer) (step S830). The band split performed in the step S830 is also the same as that described above. However, unlike the single frame loss case in which the transform coefficients of the previous good frame are spit into M bands, in step 830, the transform coefficients recovered in the previous good frame are split into M bands.

The decoder determines whether there is a tonal component of the previous frame (recovered frame) (step S840). For example, if the current frame (lost frame) is an $n^{th}$ frame, the decoder may determine how many tonal components there are for each band by using transform coefficients grouped into M bands of an $(n-1)^{th}$ frame which is a lost frame as the previous frame of the current frame.

A tonality may be determined on the basis of a spectrum similarity in a log axis by using a per-band transform coefficient. For example, in case of grouping the transform coefficient into three bands (M=3), transform coefficients of the previous frame are classified into 3 bands, and a tonality may vary for each band. For example, it may be determined that a first band has a tonal component, a second band does not have a tonal component, and a third band has a tonal component.

As such, the tonality may be determined differently for each band, and a per-band attenuation constant may be derived according to the tonality.

The decoder may derive an attenuation constant to be applied to the current frame by applying an additional attenuation element to an attenuation constant of the previous frame (step S850).

More specifically, if p frames are continuously lost (if a loss of a frame #p occurs continuously), it is determined such that a first attenuation constant for a first frame loss is 4 an additional attenuation constant for a second frame lost is an additional attenuation constant for a $q^{th}$ frame loss is $\lambda_2, \ldots,$ and an additional attenuation constant for a $p^{th}$ frame loss is $\lambda_p$ (herein, p and q are integers, where q<p). In this case, an attenuation constant applied to the $q^{th}$ frame among lost frames may be derived from a product of their first attenuation constants and/or additional attenuation constants.

In this case, a great additional attenuation may be applied to a band having a strong tonality, and a small additional attenuation may be applied to a band having a weak tonality. Therefore, the additional attenuation may be increased when the tonality of the band is great, and the additional attenuation may be decreased when the tonality of the band is small.

For example, as to an $r^{th}$ frame loss (where r is an integer), an additional attenuation constant of a band having a strong tonality, i.e., $\lambda_{r,strong\ tonality}$, has a value greater than or equal to an additional attenuation constant of a band having a weak tonality, i.e., $\lambda_{r,weak\ tonality}$, as expressed by Equation 6.

$$\lambda_{r,strong\ tonality} \leq \lambda_{r,strong\ tonality} \quad \text{<Equation 6>}$$

For example, it is assumed a case where three frames are continuously lost. Herein, in case of a band having a strong tonality, a first attenuation constant for a first frame loss may be set to 1, and an additional attenuation constant for a second frame loss may be set to 0.9, and an additional attenuation constant for a third frame loss may be set to 0.7. In case of a band having a weak tonality, the first attenuation constant for the first frame loss may be set to 1, and the additional attenuation constant for the second frame loss may be set to 0.95, and the additional attenuation constant for the third frame loss may be set to 0.85.

Although the additional attenuation constant may be set differently according to whether the band has the strong tonality or the weak tonality, the first attenuation constant for the first frame loss may be set differently according to whether the band has the strong tonality or the weak tonality, or may be set irrespectively of the tonality of the band.

The decoder applies the derived attenuation constant to a band of the previous frame (step S860), thereby being able to recover a transform coefficient of the current frame.

The decoder may apply the attenuation constant derived for each band to a band corresponding to the previous frame (recovered frame). For example, if the current frame is a $n^{th}$ frame (lost frame) and an $(n-1)^{th}$ frame is a recovered frame, the decoder may obtain transform coefficients constituting a $k^{th}$ band of the current frame ($n^{th}$ frame) by multiplying an attenuation constant for the $k^{th}$ band by transform coefficients for constituting a $k^{th}$ band of the recovered frame ($(n-1)^{th}$ frame). The decoder may recover transform coefficients of the $n^{th}$ frame (current frame) for all bands by multiplying an attenuation constant corresponding to each band of the $(n-1)^{th}$ frame.

The decoder may inverse-transform the recovered transform coefficient (step S880). The decoder may generate an SWB-extended signal by inverse-transforming (IMDCT) the recovered transform coefficient (MDCT coefficient), and may output an SWB signal by adding to a WB signal.

Meanwhile, although it is described in FIG. 8 that the first attenuation constant and the additional attenuation constant are set according to the tonality, the present invention is not limited thereto.

For example, at least one of the first attenuation constant and the additional attenuation constant may be derived according to the tonality. More specifically, the decoder may calculate an attenuation constant as described in steps S625 and S630 on the basis of a correlation with transform coefficients of a recovered frame and a good frame stored in a frame backup buffer as to a band having a strong tonality. In this case, if it is assumed that h frames (where h is an integer) are continuously lost and the current frame is a $h^{th}$ frame among lost frames of the current frame, as an attenuation constant for a first frame among recovered frames, an attenuation constant stored in the frame backup buffer is a first attenuation constant, and attenuation constants from a second recovered frame to the current frame are additional attenuation constants. Therefore, as to the current frame, the attenuation constant of the band having the strong tonality may be derived by a product of an attenuation constant derived for the current frame and attenuation constants for previous (h−1) continuous recovered frames as expressed by Equation 7.

$$\lambda_{ts,current}=\lambda_{ts1}*\lambda_{ts2}*\ldots*\lambda_{tsh} \quad \text{<Equation 7>}$$

In Equation 7, $\lambda_{ts,current}$ is an attenuation constant applied to a previous recovered frame for deriving a transform coefficient of the current frame, $\lambda_{ts2}$ is an attenuation constant for a first frame loss as to h continuous frame losses, $\lambda_{ts2}$ is an attenuation constant for a second frame loss, and $\lambda_{tsh}$ is an attenuation constant derived on the basis of a correlation with previous frames as to the current frame. The attenuation constants may be derived for each band as to the band having the strong tonality.

Further, as to the band having the weak tonality, the decoder may calculate an attenuation constant as described in steps S635 and S645 on the basis of an energy of transform coefficients of the recovered frame and the good frame stored in the frame backup buffer. In this case, if it is assumed that h frames (where h is an integer) are continuously lost and the current frame is a $h^{th}$ frame among lost frames of the current frame, as an attenuation constant for a first frame among recovered frames, an attenuation constant stored in the frame backup buffer is a first attenuation constant, and attenuation constants from a second recovered frame to the current frame are additional attenuation constants. Therefore, as to the current frame, the attenuation constant of the band having the weak tonality may be derived by a product of an attenuation constant derived for the current frame and attenuation constants for previous (h−1) continuous recovered frames as expressed by Equation 8.

$$\lambda_{tw,current}=\lambda_{tw1}*\lambda_{tw2}*\ldots*\lambda_{twh} \quad \text{<Equation 8>}$$

In Equation 8$\lambda_{tw,current}$ is an attenuation constant applied to a previous recovered frame for deriving a transform coefficient of the current frame, $\lambda_{tw1}$ is an attenuation constant for a first frame loss as to h continuous frame losses, $\lambda_{tw2}$ is an attenuation constant for a second frame loss, and $\lambda_{twh}$ is an attenuation constant derived on the basis of a correlation with previous frames as to the current frame. The attenuation constants may be derived for each band as to the band having the weak tonality.

Figure 9:
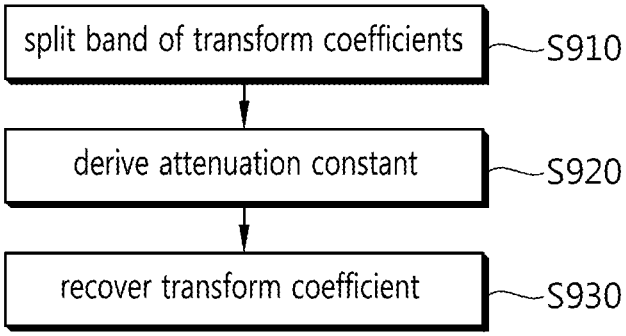
FIG. 9 is a flowchart for briefly explaining an example of a method of recovering (concealing) a frame loss according to the present invention.

FIG. 9 is a flowchart for briefly explaining an example of a method of recovering (concealing) a frame loss according to the present invention. An operation of FIG. 9 may be performed in a decoder or may be performed in a frame loss concealment unit in the decoder. For convenience of the explanation, it is described herein that the operation of FIG. 9 is performed in the decoder.

Referring to FIG. 9, the decoder performs grouping on transform coefficients of at least one frame among previous frames of a current frame into a specific number of bands (step S910). In this case, the current frame may be a lost frame, and previous frames of the current frame may be a recovered frame or a good frame (normal frame) stored in a frame backup buffer.

The decoder may derive an attenuation constant according to a tonality of grouped bands (step S920). In this case, the attenuation constant may be derived on the basis of transform coefficients of previous N good frames (where N is an integer) of the current frame. N may denote the number of buffers for storing information of the previous frames.

In addition, in a band having a strong tonality of a transform coefficient, an attenuation constant may be derived on the basis of a correlation between transform coefficients of the previous good frames (normal frames). In a band having a weak tonality of the transform coefficient, the attenuation constant may be derived on the basis of an energy for the previous good frames.

In addition, the attenuation constant may be derived on the basis of transform coefficients of the previous N good frames and recovered frames (where N is an integer) of the current frame. N may denote the number of buffers for storing information of the previous frames.

In addition, in the band having the strong tonality of the transform coefficient, the attenuation constant may be derived on the basis of a correlation between previous good frames and recovered frames. In the band having the weak tonality of the transform coefficient, the attenuation constant may be derived on the basis of energies for the previous good frames and recovered frames.

Details of the attenuation constant are the same as described above in detail.

The decoder may recover a transform coefficient of a current frame by applying an attenuation constant of a previous frame of the current frame (step S930). The transform coefficient of the current frame may be recovered to a value obtained by multiplying an attenuation constant derived for each band by a per-band transform coefficient of the previous frame. If the previous frame of the current frame is a recovered frame, that is, if continuous frames are lost, the transform coefficient of the current frame may be recovered by additionally applying the attenuation constant of the current frame to the attenuation constant of the previous frame.

Details of a method of recovering a transform coefficient of the current frame (lost frame) by applying an attenuation constant are the same as described above.

Figure 10:
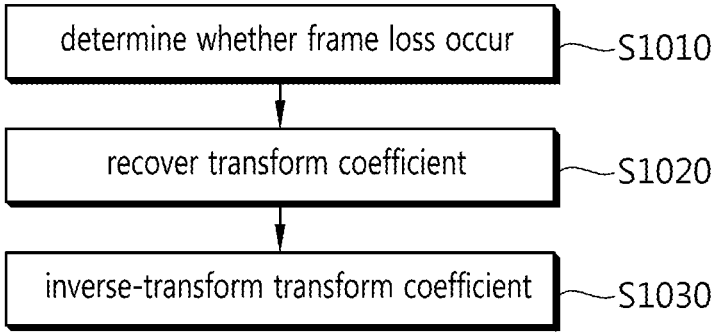
FIG. 10 is a flowchart for briefly explaining an example of an audio decoding method according to the present invention.

FIG. 10 is a flowchart for briefly explaining an example of an audio decoding method according to the present invention. An operation of FIG. 10 may be performed in a decoder.

Referring to FIG. 10, the decoder may determine whether a current frame is lost (step S1010).

If the current frame is lost, the decoder may recover transform coefficients of the current frame on the basis of transform coefficients of previous frames of the current frame (step S1020). In this case, the decoder may recover the transform coefficient of the current frame on the basis of a per-band tonality of transform coefficients of at least one frame among previous frames.

Recovering of a transform coefficient may be performed by grouping transform coefficients of at least one frame into a predetermined number of bands among previous frames of a current frame, by deriving an attenuation constant according to a tonality of the grouped bands, and by applying the attenuation constant to the previous frame of the current frame. In this case, if the previous frame of the current frame is the recovered frame, the transform coefficient of the current frame may be recovered by additionally applying an attenuation constant of the current frame to an attenuation constant of the previous frame. The attenuation constant additionally applied to a band having a strong tonality may be less than or equal to an attenuation constant additionally applied to a band having a weak tonal component.

As to the grouping of bands, the deriving of an attenuation constant, and the applying of the attenuation constant, the same as those explained in detail in an earlier part of the present specification in addition to FIG. 9 is applied.

The decoder may inverse-transform the recovered transform coefficient (step S1030). If the recovered transform coefficient (MDCT coefficient) is for an SWB, the decoder may generate an SWB-extended signal through inverse-transformation (IMDCT), and may output an SWB signal by adding to a WB signal.

Meanwhile, a criterion for a tonality has been expressed up to now in this specification by three types of expressions: (a) there are many tonal components & there is no tonal component; (b) there are many tonal components & there is no or small tonal components; and (c) there is a tonality & there is (small or) no tonality. However, it should be noted that the three types of expressions are for convenience of explanation and thus indicate not different criteria but the same criterion.

In other words, in the present specification, the three types of expressions of "there is a tonal component", "there are many tonal components", and "there is a tonality" all imply that there is a tonal component greater in amount than a specific reference value, and the three types of expressions of "there is no tonal component", "there is no or small tonal components", and "there is (small or) no tonality)" all imply that there is a tonal component less in amount than the specific reference value.

Although methods of the aforementioned exemplary embodiments have been described on the basis of a flowchart in which steps or blocks are listed in sequence, the steps of the present invention are not limited to a certain order. Therefore, a certain step may be performed in a different step or in a different order or concurrently with respect to that described above. In addition, the aforementioned exemplary embodiments include various aspects of examples. For example, the aforementioned embodiments may be performed in combination, and this is also included in the embodiments of the present invention. All replacements, modifications and changes should fall within the spirit and scope of the claims of the present invention.

What is claimed is:

1. A method of recovering a frame loss, the method comprising:

grouping transform coefficients of at least one frame into a predetermined number of bands among previous frames of a current frame;

deriving an attenuation constant according to a tonality of the bands; and recovering transform coefficients of the current frame by applying the attenuation constant to the previous frame of the current frame, wherein, in a band having a strong tonality, the attenuation constant is derived on the basis of a correlation between transform coefficients of previous normal frames.

2. The method of claim 1, wherein the attenuation constant is derived on the basis of transform coefficients of previous N normal frames (where N is an integer) of the current frame.

3. The method of claim 2, wherein the N is the number of buffers for storing information of the previous frame.

4. The method of claim 1, wherein a per-band correlation is used as a per-band attenuation constant, and a band having a high positional correlation of an inter-frame sinusoidal pulse has a high correlation.

5. The method of claim 4, wherein the per-band correlation is calculated based on a following equation, $$\text{correlation} = W_m \times \sum_{band-start}^{band-end} (N_{i,n-1} \times N_{i,n-2})$$

where, $W_m$ denotes a weight for the current band, n represents an index number of the current frame, $N_{i,n-1}$ denotes an i-th sinusoidal pulse of an (n−1)-th frame, and $N_{i,n-2}$ denotes an i-th sinusoidal pulse of an (n−2)-th frame.

6. The method of claim 1, wherein the transform coefficient of the current frame is recovered to a value obtained by multiplying an attenuation constant derived for each band by a per-band transform coefficient of the previous frame.

7. The method of claim 6, wherein if the previous frame of the current frame is a recovered frame, the transform coefficient of the current frame is recovered by additionally applying the attenuation constant of the current frame to the attenuation constant of the previous frame.

8. An audio decoding method comprising:

determining whether there is a loss in a current frame;

if the current frame has lost, recovering a transform coefficient of the current frame on the basis of transform coefficients of previous frames of the current frame; and inverse-transforming the recovered transform coefficient, wherein the recovering of the transform coefficient comprises:

grouping transform coefficients of at least one frame into a predetermined number of bands among previous frames of the current frame;

deriving an attenuation constant according to a tonality of the bands; and recovering transform coefficients of the current frame by applying the attenuation constant to the previous frame of the current frame, and wherein, in a band having a strong tonality, the attenuation constant is derived on the basis of a correlation between transform coefficients of previous normal frames.

9. The audio decoding method of claim 8, wherein the attenuation constant is derived on the basis of transform coefficients of a specific number of previous normal frames of the current frame.

10. The audio decoding method of claim 8, wherein the transform coefficient of the current frame is recovered to a value obtained by multiplying an attenuation constant derived for each band by a per-band transform coefficient of the previous frame.

11. The audio decoding method of claim 10, wherein if the previous frame of the current frame is a recovered frame, the transform coefficient of the current frame is recovered by additionally applying the attenuation constant of the current frame to the attenuation constant of the previous frame.

* * * * *